United States Patent [19]

McDonie et al.

[11] Patent Number: 4,604,545

[45] Date of Patent: Aug. 5, 1986

[54] PHOTOMULTIPLIER TUBE HAVING A HIGH RESISTANCE DYNODE SUPPORT SPACER ANTI-HYSTERESIS PATTERN

[75] Inventors: Arthur F. McDonie; Richard D. Faulkner, both of Lancaster, Pa.

[73] Assignee: RCA Corporation, Princeton, N.J.

[21] Appl. No.: 172,659

[22] Filed: Jul. 28, 1980

[51] Int. Cl.[4] ..... H01J 43/00

[52] U.S. Cl. ..... 313/105 CM; 313/103 CM

[58] Field of Search ..... 313/105, 95, 105 R, 313/103 R, 105 CM, 103 CM, 250

[56] References Cited

U.S. PATENT DOCUMENTS

| | | | |
|---|---|---|---|
| 3,114,044 | 12/1963 | Sternglass | 250/207 |
| 3,235,765 | 2/1966 | Goodrich et al. | 315/12 |
| 3,239,709 | 3/1966 | Ramberg | 313/95 |
| 3,243,628 | 3/1966 | Matheson | 313/103 CM |
| 3,321,660 | 5/1967 | Ramberg | 313/103 |
| 3,873,867 | 3/1975 | Girvin | 313/95 |
| 3,899,706 | 8/1975 | Ball | 313/105 |
| 4,010,312 | 3/1977 | Pinch et al. | 428/450 |

FOREIGN PATENT DOCUMENTS 43-443 1/1968 Japan .

*Primary Examiner*—David K. Moore

*Attorney, Agent, or Firm*—Eugene M. Whitacre; Dennis H. Irlbeck; Vincent J. Coughlin, Jr.

[57] ABSTRACT

The photomultiplier tube comprises an evacuated envelope having therein a photocathode, an anode, a plurality of spaced apart dynodes for propagating and concatenating electron emission from the photocathode to the anode and a pair of substantially parallel support spacers of insulating material to support the dynodes and the anode. A chrome oxide layer is disposed on the support spacers adjacent to the dynodes and the anode. The chrome oxide layer has a resistance of at least about $10^{12}$ ohms per square to about $10^{15}$ ohms per square. A Nichrome coating overlies an inter-electrode region extending along the concatenating path of the electron emission from the dynodes to the anode. The Nichrome coating has a resistance of greater than $10^{6}$ ohms per square but less than the resistance of the chrome oxide layer.

10 Claims, 2 Drawing Figures

PHOTOMULTIPLIER TUBE HAVING A HIGH RESISTANCE DYNODE SUPPORT SPACER ANTI-HYSTERESIS PATTERN

BACKGROUND OF THE INVENTION

The invention relates to a photomultiplier tube and particularly to a structure for reducing the dark current of the tube.

In certain photomultiplier tube applications operational instability may occur when the anode current level abruptly changes due to changes in the input signal. In such instances, it has been noted that a conductive pattern such as that disclosed in U.S. Pat. No. 3,873,867, to Girvin, issued Mar. 25, 1975, may be used to focus the electrons so that they will not impinge upon the insulating support spacers which hold the dynodes of the tube. The conductive pattern is intended to prevent the support spacers from charging under electron bombardment. By reducing the charging of the spacers the operational instability condition commonly known as "hysteresis" is prevented. The Girvin patent suggests that a conductive coating consisting of molybdenum material applied by a silk screening technique may be deposited on the ceramic spacer. Alternatively, it is also known that other materials such as aluminum or nickel may also be used. The conductive pattern is generally tied to the same potential as the first dynode; however, other potentials between first dynode potential and anode potential may also be used.

The aforementioned conductive coating generally has a resistance in the neighborhood of a few ohms per square and typically a conductive pattern having a resistance of one ohm per square is produced by the silk screening process. Tubes having the aforedescribed conductive pattern, which is fixed at or near the potential of the first dynode, are prone to exhibit excessive dark current when operated near the maximum operating voltage. This phenomenon is believed due to the fact that the conductive pattern which extends along the electron path from the first dynode to the anode creates a high electric field in the neighborhood of the last dynode adjacent to the anode. The electric field causes luminescence in the ceramic which feeds light back to the photocathode to increase the dark current by generating a spurious input signal. This problem is especially severe in the so called "tea-cup" photomultiplier tube used for scintillation counting. The tea-cup photomultiplier tube must pass a stringent dark current test at 1500 volts. A number of tea-cup photomultiplier tubes having silk-screened conductive nickel coatings disposed on chrome oxide coated support spacers have been unable to meet the dark current requirement. The chrome oxide, it has been found, quenches some of the electric field induced luminescence; however, the amount of light fed back to the photocathode is still sufficient to create excessive dark current within the tube. As a consequence, it is necessary to bake the photomultiplier tube at an elevated temperature in order to reduce the dark current. The baking process has an undesirable side effect in that it tends to reduce the cathode sensitivity of the tube and degrade the pulse height resolution of the tube while reducing the dark current. It is thus desirable to reduce the dark current by eliminating or reducing the high electric field that is present near the anode end of the conductive pattern that is formed on the support spacers.

SUMMARY OF THE INVENTION

A photomultiplier tube comprises an evacuated envelope having therein a photocathode, an anode, a plurality of spaced apart dynodes for propagating and concatenating electron emission from the photocathode to the anode. A pair of substantially parallel support spacers of insulating material support the dynodes and the anode. A coating disposed on the support spacers overlies an inter-electrode region extending along a concatenating path of the electron emission from the dynodes to the anode. The coating has a resistance greater than about $10^6$ ohms per square but less than about $10^{12}$ ohms per square.

DESCRIPTION OF THE PREFERRED EMBODIMENT

Figure 1:
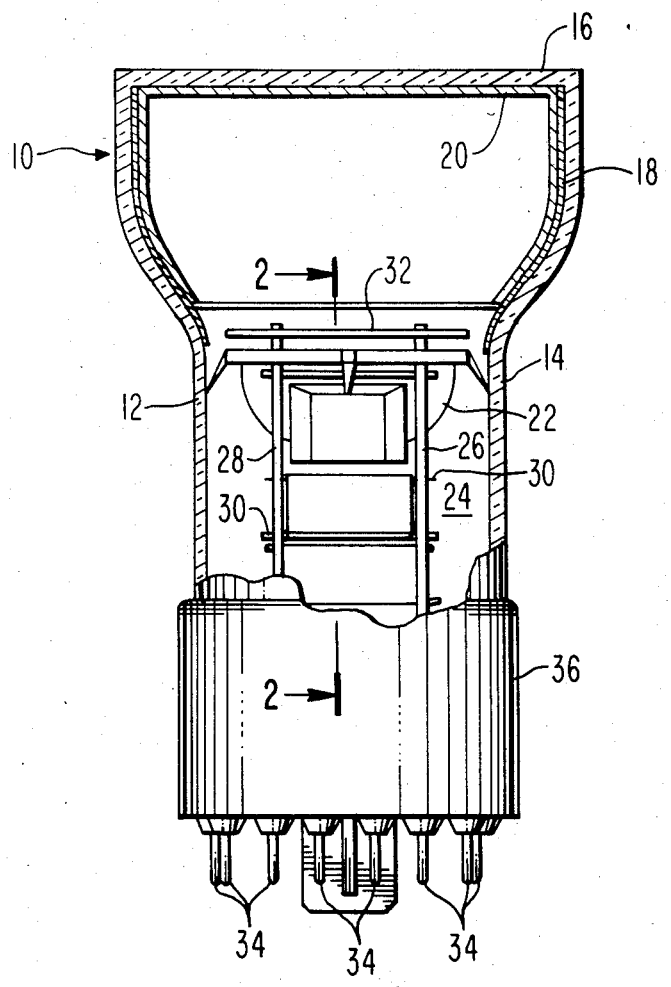
FIG. 1 is a cut-away perspective view of one example of a photomultiplier tube made in accordance with the present invention.
Figure 2:
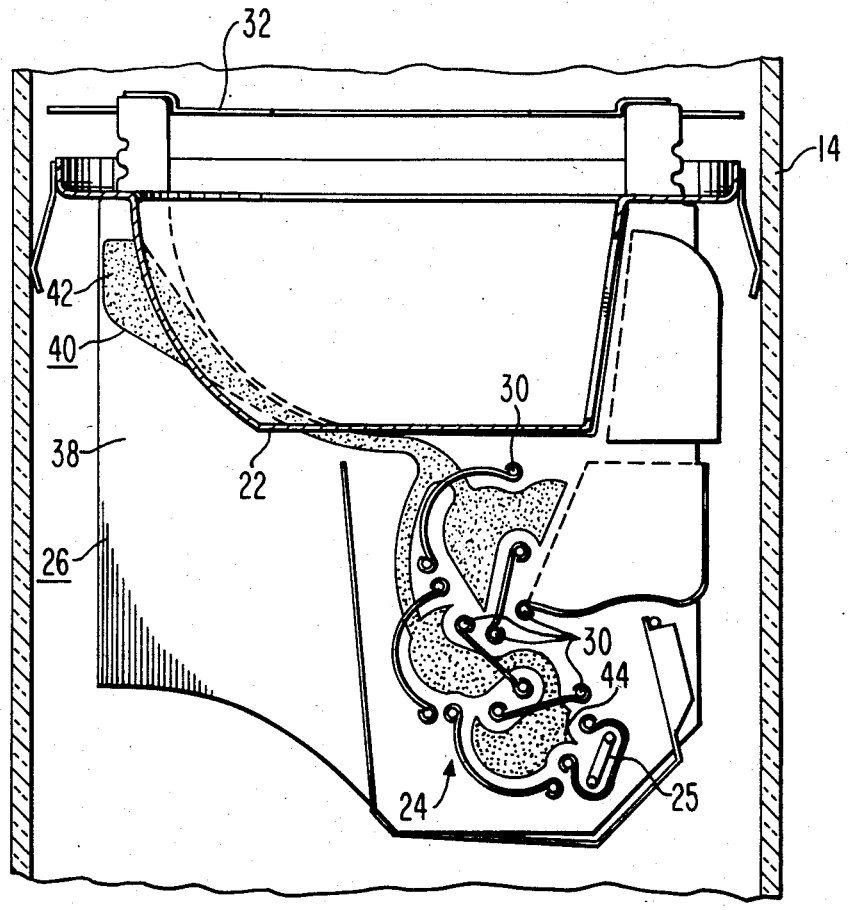
FIG. 2 is a partial cross sectional view of the tube depicted in FIG. 1 showing the novel dark current reducing resistance coating on one of the support spacers.

Referring to FIG. 1 and 2 there is shown a photomultiplier tube 10 comprising an envelope 12 having a generally cylindrical sidewall 14 and a faceplate 16. An aluminum coating 18 is disposed on a portion of the sidewall 14 adjacent to the faceplate 16. Within the tube 10 is a photocathode 20 on the faceplate 16 and also along a portion of the aluminum coating on the sidewall 14. The photocathode 20 may be potassium-cesium-antimonide, for example, or any one of a number of photoemissive materials well known in the art. Inside the tube 10 is a primary or first tea-cup dynode 22 facing the faceplate 16. An array of secondary dynodes 24 is disposed between the tea-cup dynode 22 and an anode 25. The tea-cup 22 and the plurality of secondary dynodes comprising the dynode array 24 are supported by a pair of insulating support spacers 26 and 28, respectively. The support spacers 26 and 28 may be made of any insulating material although a machinable material such as a high alumina ceramic is preferred. The primary dynode 22 and the secondary dynodes 24 are attached to the dynode spacers 26 and 28 by a plurality of support rods 30 which extend through small apertures in the support spacers 26 and 28. A focus electrode 32 disposed between the faceplate 16 and the first dynode 22 is attached to one end of the support spacers 26 and 28. Connecting wires, not shown, extend between the dynode support rods 30 and lead-in pins 34 in the tube base 36.

Both of the support spacers 26 and 28 have uniformly disposed thereon a high resistance coating 38 of a material such as chrome oxide ($Cr_2O_3$) Only the spacer 26 is shown in FIG. 2. The chrome oxide coating is generally applied by a spray technique well known in the art. The sprayed ceramic spacers are fired prior to tube assembly in a water saturated hydrogen atmosphere at a temperature of about 1000° C. for a period of about 15 minutes in order to cure the chrome oxide coating. The fired chrome oxide coating has a resistance in a range of $10^{12}$ to $10^{15}$ ohms per square and has a thickness of approximately 0.0005 ohms to about 0.001 inches (0.0127 to 0.0254 mm). The spray technique of depositing the chromic oxide material on the ceramic produces a uniform but slightly "rough" surface having a surface roughness of approximately 2 to 7 μm.

In the prior art a nickel conductive pattern was silk-screened onto the chrome oxide coating 38, along an interelectrode region extending from the first dynode 22 to the anode 25. The conductive nickel pattern typically had a resistance of about one ohm per square. The present novel structure utilizes a similarly shaped evaporated coating 40 overlying the interelectrode region extending along a concatenating path from the first dynode 22 to the anode 25. The coating 40 is preferably of Nichrome although chromium, nickel, platinum, or rhodium may be used. These materials are compatible with the alkali materials generated during the formation of the photocathode 20, i.e., they do not react physically or electrically with the alkali material, and thus do not flake-off the chrome oxide coating 38 or readily change in electrical characteristics after the introduction of the alkali materials. By properly evaporating a relatively "thin", i.e. about 1000 to 1200 Å, pattern of Nichrome, the resistance of the Nichrome coating 40 may be held in a range of about $10^6$ to $10^{12}$ ohms per square, although the range of $10^6$ to $10^8$ ohms per square is perferred.

The fact that conductive materials such as Nichrome, chromium, nickel, platinum, or rhodium may be evaporated to produce high resistance coatings is attributable to the fact that the relatively "thin" metallic layer disposed on the relatively "rough" chrome oxide layer produces sufficient discontinuities in the "thin" layer so as to render it a high resistance coating. The support spacer 28 has a mirror-image Nichrome coating (not shown) formed thereon in the manner described above for the coating 40.

An alternative to the above-described evaporated coating 40 includes a cermet film such as that described in U.S. Pat. No. 4,010,312 to Pinch et al, issued on Mar. 1, 1977 and incorporated by reference herein. The cermet film is disposed directly on the support spacers 26 and 28 in a pattern identical to that of evaporated coating 40. The cermet film is annealed in a reducing atmosphere to the desired resistance range.

Tubes made utilizing the present novel structure have shown satisfactory dark current readings at or near the maximum operating voltage of the tubes. The problem of luminescence discussed in the background of the invention, and believed related to the high electric fields in the vicinity of the anode 25, generated by the presence of first dynode potential on the prior art conductive nickel coating has been eliminated in the present novel structure. It is believed that the mechanism for the elimination of luminescence is due either to the inability to draw a high current because of the high impedance of the Nichrome coating 40, or because a voltage drop occurs across the high impedance Nichrome coating. In the present novel structure an upper end 42 of the Nichrome pattern 40 is at first dynode potential; however, the lower end 44 of the pattern adjacent to the anode 25 in the dynode array 24 floats with respect to the upper end 42 and thus is at a potential which is believed to be somewhat lower than that which exists at the upper end of the Nichrome pattern 40.

What is claimed is:

1. A photomultipler tube comprising:

an evacuated envelope;

a photocathode within said envelope;

an anode spaced from said photocathode;

a plurality of spaced apart dynodes for propagating and concatenating electron emission from said photocathode to said anode;

a pair of substantially parallel support spacers of insulating material to support said dynodes and said anode;

a coating disposed on said support spacers and overlying an interelectrode region extending along a concatenating path of said electron emission from said dynodes to said anode, said coating having a resistance of greater than about $10^6$ ohms per square but less than $10^{12}$ ohms per square.

2. The tube as in claim 1 further including a uniform resistive layer disposed between said coating and said support spacers, said layer having a resistance of at least about $10^{12}$ ohms per square to about $10^{15}$ ohms per square.

3. The tube as in claim 2 wherein said layer comprises chrome oxide and the coating includes a metal that is compatible with alkali metals.

4. The tube as in claim 3 wherein the coating is a metal selected from the group consisting of Nichrome, chromium, nickel, platinum and rhodium.

5. The tube as in claim 3 wherein said coating comprises a cermet film.

6. The tube as in claim 3 wherein the metal coating has a thickness of about 1000–1200 Å.

7. A photomultiplier tube comprising an evacuated envelope, a photocathode within said envelope, an anode spaced from said photocathode, a plurality of spaced apart dynodes for propagating and concatenating electron emission from said photocathode to said anode, a pair of substantially parallel support spacers of insulating material to support said dynodes and said anode, and a metal coating disposed on said support spacers and overlying an interelectrode region extending along a concatenating path of said electron emission from said dynodes to said anode, said metal coating having a resistance of about $10^6$ ohms per square but less than $10^8$ ohms per square.

8. The tube as in claim 7, further including a uniform resistive layer of chrome oxide disposed between said metal coating and said support spacers, said layer of chrome oxide having a resistance of at least $10^{12}$ ohms per square to about $10^{15}$ ohms per square.

9. A photomultiplier tube comprising an evacuated envelope, a photocathode within said envelope, an anode spaced from said photocathode, a plurality of spaced apart dynodes for propagating and concatenating electron emission from said photocathode to said anode, a pair of substantially parallel support spacers of insulating material to support said dynodes and said anode, a uniform resistive layer of chrome oxide disposed on said support spacers, said chrome oxide layer having a surface roughness of about 2 to 7 μm, said layer of chrome oxide having a resistance of at least $10^{12}$ ohms per square to about $10^{15}$ ohms per square, and a coating disposed on said chrome oxide layer and overlying an interelectrode region extending along a concatenating path of said electron emission from said dynodes to said anode, said coating having sufficient disconinuities therein to provide a resistance of greater than about $10^6$ ohms per square but less than $10^{12}$ ohms per square.

10. The tube as in claim 9, wherein said coating is a metal selected from the group consisting of Nichrome, chromium, nickel, platinum and rhodium.

* * * * *